US006325072B1

(12) United States Patent
Smetana

(10) Patent No.: US 6,325,072 B1
(45) Date of Patent: Dec. 4, 2001

(54) HAIR TREATMENT APPLIANCE

(75) Inventor: Heike Smetana, Kronberg (DE)

(73) Assignee: Braun GmbH, Frankfurt (DE)

( * ) Notice: Subject to any disclaimer, the term of this patent is extended or adjusted under 35 U.S.C. 154(b) by 0 days.

(21) Appl. No.: 09/641,934

(22) Filed: Aug. 18, 2000

Related U.S. Application Data

(63) Continuation of application No. PCT/EP99/00966, filed on Feb. 13, 1999.

(30) Foreign Application Priority Data

Mar. 12, 1998 (DE) ..... 198 10 598

(51) Int. Cl.[7] ..... A45D 6/06; A45D 1/04
(52) U.S. Cl. ..... 132/228; 132/229
(58) Field of Search ..... 132/228, 200, 132/229, 233

(56) References Cited

U.S. PATENT DOCUMENTS

| | | | | |
|---|---|---|---|---|
| 2,254,266 | * | 9/1941 | Cannon | 132/228 |
| 2,880,299 | * | 3/1959 | Jones | 132/228 |
| 3,220,421 | * | 11/1965 | Van Droogenbroek et al. | 132/228 |
| 3,610,259 | | 10/1971 | Brown . | |
| 3,768,491 | * | 10/1973 | Barradas | 132/228 |
| 3,903,904 | * | 9/1975 | Hemrich et al. | 132/228 |
| 3,960,160 | * | 6/1976 | Hogan | 132/200 |
| 4,009,367 | | 2/1977 | Rizzuto | 219/222 |
| 4,166,473 | * | 9/1979 | Bauer et al. | 132/228 |
| 4,209,685 | | 6/1980 | Walter et al. . | |
| 4,419,565 | | 12/1983 | McGraw | 219/222 |
| 5,223,694 | | 6/1993 | Tsuji et al. | 219/225 |
| 5,584,307 | | 12/1996 | Bauer et al. . | |
| 5,601,812 | * | 2/1997 | Grossman | 424/70.15 |

FOREIGN PATENT DOCUMENTS

| | | | |
|---|---|---|---|
| 550696 | 9/1956 | (BE) . | |
| 43 26 223 A1 | 2/1995 | (DE) . | |
| 44 40 315 A1 | 5/1996 | (DE) . | |
| 197 44 688 A1 | 4/1998 | (DE) . | |
| 197 09 360 A1 | 9/1998 | (DE) . | |
| 0 346 067 A2 | 12/1989 | (EP) | A45D/1/04 |
| 718954 | 1/1932 | (FR) . | |
| 1379083 | 7/1967 | (FR) . | |
| 07194428 | 8/1995 | (JP) . | |
| 8-25618 | 1/1996 | (JP) . | |
| H8-85 | 1/1996 | (JP) | A45D/1/04 |
| H8-80215 | 3/1996 | (JP) | A45D/2/38 |
| P4-367611A2 | 12/1992 | (JP) | A45D/20/50 |
| WO 86/04220 | 7/1986 | (WO) . | |

* cited by examiner

*Primary Examiner*—John J. Wilson
*Assistant Examiner*—Robyn Kieu Doan
(74) *Attorney, Agent, or Firm*—Fish & Richardson P.C.

(57) ABSTRACT

The invention is directed to a hair treatment appliance (1), comprising two elongate tong elements (2, 3) which are movable relative to each other and between which the hair is insertable with the tongs in an open position and between which the hair may be pulled through with the tongs in a closed position. Provision is made for an arrangement for generating steam introducible between the two tong elements (2, 3). A device is provided which, using the generated steam, is capable of introducing a hair treatment agent between the two tong elements (2, 3). The appliance (1) is not only suitable for use as a steam crimper but affords the added possibility of being used for the application of a hair treatment agent to the hair and the treatment of the hair with said agent.

12 Claims, 1 Drawing Sheet

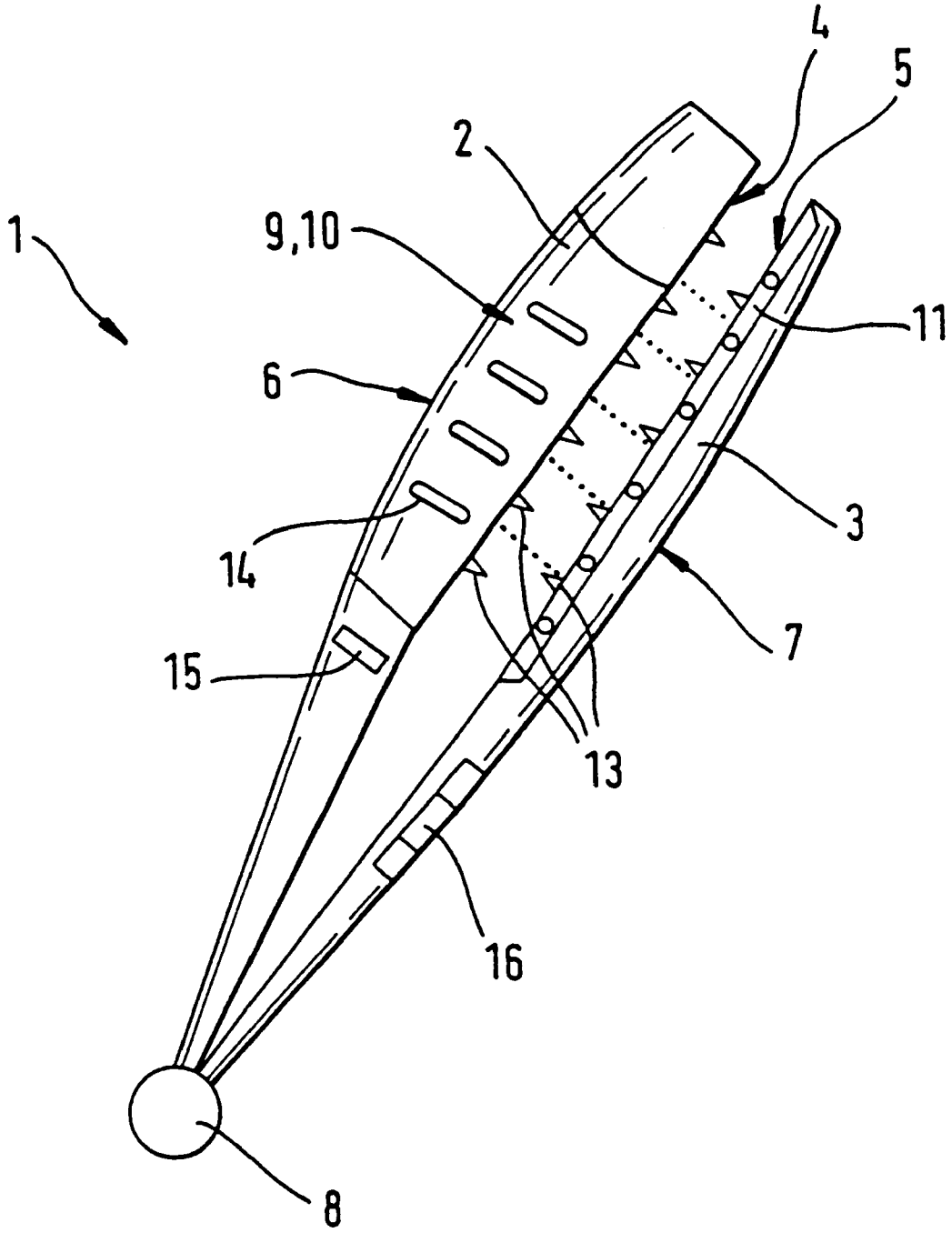
1
2
3
4
5
6
7
8
9,10
11
13
14
15
16

HAIR TREATMENT APPLIANCE

This is a continuation of PCT application serial no. PCT/EP99/00966, filed Feb. 13, 1999, which claims priority from German application serial number 19810598.3, filed Mar. 12, 1998, (pending).

BACKGROUND

This invention relates to a hair treatment appliance, comprising two elongate tong elements which are movable relative to each other and between which the hair is insertable with the tongs in an open position and between which the hair may be pulled through with the tongs in a closed position, and further comprising an arrangement for generating steam introducible between the two tong elements.

An appliance of this type is frequently referred to as a steam crimper and is commercially available. Known steam crimpers include two elongate, for example, about cylindrical tong elements which are hingedly connected with each other. Accommodated in the two tong elements is a heating element or the like for producing water vapor, for example. With the tongs in open position, a user's hair is placed between them. When the tongs are subsequently moved to the closed position, steam is conveyed to the region between the two tong elements and hence to the hair received therein. In closed condition of the tongs, the hair is then pulled through between the two tongs, so that the entire length of the hair is exposed to steam. Such steam crimpers operate substantially to straighten the hair.

SUMMARY OF THE INVENTION

It is an object of the present invention to provide a hair treatment appliance which enables a hair treatment to be performed that goes beyond the straightening of hair.

This object is accomplished by the invention in an appliance of the type initially referred to by providing a device which, using the generated steam, is capable of introducing a hair treatment agent between the two tong elements.

The present invention affords the possibility of treating hair in particularly simple manner by means of a hair treatment agent. In contrast to known steam crimpers with which essentially only a straightening effect can be achieved by a steam treatment, the appliance of the present invention provides the beneficial effect of adding a hair treatment agent and using it on the hair. With the invention an appliance is provided which is capable of imparting enhanced shine and/or greater suppleness and/or improved combability and/or special protection to the hair being treated by virtue of the active substances contained in the hair treatment agent. Insofar the present invention does not present a simple steam crimper but rather a novel "application crimper" providing the user with application possibilities heretofore not available for styling his or her own hair.

Preferably, the hair treatment agent is acted upon by the generated steam and hence put into effect. This has the advantage of eliminating the need for elaborate additional components or the like to implement the appliance of the invention. Instead the steam already available is utilized to apply the hair treatment agent (e.g., to activate or liquefy it) and hence enable the hair to be treated with the hair treatment agent.

In an advantageous aspect of the present invention the device is arranged such that the hair treatment agent is exposed to the generated steam. This presents a simple way of causing the generated steam to reach the hair treatment agent, putting it into effect. The steam thus feeds the hair treatment agent to the hair needing to be treated automatically and without any other additional devices. This ensures ease and at the same time convenience in handling the appliance of the invention.

Particularly advantageously, the hair treatment agent is activatable by the generated steam, in particular liquefiable, and is suitable for application to the hair in combination with the steam. In this manner any additional components are avoided, hence simplifying the constructional arrangement of the appliance of the present invention materially.

In an advantageous further aspect of the invention, the device is received in one of the two tong elements, in particular on the side of the tong element close to the hair (and the opposite tong element). It will thus be seen that the invention makes use of already existing components to accommodate the device with the hair treatment agent. The requirement of having to provide additional components which add expense to the device is obviated. Similarly, a straightforward construction affording ease of handling for its user is thereby accomplished with the appliance of the invention.

In another advantageous aspect of the present invention, the device is provided for storing the hair treatment agent. The effect thereby achieved is that the user is not required to feed the hair treatment agent to the appliance of the present invention in some way or other, but rather, the hair treatment agent is already contained in the appliance. The user is thus able to operate the appliance without any further devices to treat the hair with the hair treatment agent.

Preferably, the hair treatment agent is contained in the appliance of the invention in dried form. This has the beneficial effect of prolonging the life of the hair treatment agent. This makes replacement of the hair treatment agent a task that can be performed in simple manner and without soiling one's hands. Furthermore, the operations of accommodating, storing and activating the hair treatment agent in the appliance of the invention are substantially easier to perform in dried condition, which enables the appliance to be of a simpler physical construction.

In an advantageous embodiment of the present invention the device includes a fabric-type pad or the like in which the hair treatment agent is contained. Such a pad is particularly well suited to store the hair treatment agent for a prolonged time. Equally, such a pad presents a particularly simple design implementation for accommodating and storing the hair treatment agent, providing in particular cost advantages. When the fabric-type pad is exposed to steam during use of the appliance of the invention, the steam will penetrate the pad fabric, liquefying the hair treatment agent contained in the pad. The dissolved hair treatment agent reaches the user's hair to be treated simultaneously with the steam. The use of the fabric-type pad thus also contributes to enabling the user to operate the appliance of the invention with particular ease and comfort.

It is of particular advantage for the device to comprise a felt material, in particular one or several felt layers joined to each other. The use of felt material for receiving and storing the hair treatment agent ensures a particularly uniform and constant discharge of the hair treatment agent from the felt material. Experience has also shown that the felt material exhibits a particularly good compatibility with hair, enabling the hair to be worked and treated in a particularly user friendly way.

In another advantageous aspect of the invention the device, meaning the felt material, is arranged to be replaceable. The user is thus in a position to treat the hair with different hair treatment agents speedily and without particular effort simply by replacing the device. Flexibility and possible fields of application and use of the appliance of the invention are thereby increased significantly.

In an advantageous embodiment of the invention the hair treatment agent contains a protein derivative, in particular a protein hydrolysate and/or a polyvinyl pyrrolidone and/or panthenol (and/or glucose). These substances aid in enhancing in particular the shine and/or the suppleness and/or the combability and/or the protection of the user's hair. Furthermore, these substances are particularly well suited to be stored in a dried condition, to be liquefied by exposure to steam, and to be applied to the hair in combination with the steam.

In a further advantageous aspect of the invention, the arrangement includes a heating element and a chamber for receiving a liquid, in particular for storing water. This presents a simple and economical possibility of implementing the generation of steam.

Particularly advantageously, the arrangement is received in the other tong element. In this way the components necessary for the appliance of the invention, such as heating element and water chamber for steam generation, are accommodated in one tong element, while the felt with the stored hair treatment agent is accommodated in the opposite tong element. This simplifies the entire constructional arrangement of the appliance, in addition to facilitating the manipulation of the appliance for its user.

It is of particular advantage if at least one of the two tong elements is equipped with bristles projecting in the direction of the other tong element. In this manner the hair is guided and oriented in parallel particularly as it is pulled through between the two tong elements.

Particularly advantageously, at least one cylindrical envelope surface of one of the two tong elements is heatable. This cylindrical envelope surface enables the user to dry and also, if desired, to style the hair promptly upon its moistening by the hair treatment agent and the steam.

It is particularly advantageous for at least one cylindrical envelope surface of one of the two tong elements to be provided with ribs. The result achieved with such ribs is that the hair is guided and in particular oriented in parallel as it glides along the ribbed outer surface. These ribs also afford protection against touching the heated cylindrical envelope surfaces so that the risk of personal injury resulting from these heated cylindrical envelope surfaces is reliably avoided.

Further features, application possibilities and advantages of the present invention will become apparent from the subsequent description of embodiments of the invention illustrated in the accompanying drawing. It will be understood that any single feature and any combination of single features described or represented by illustration form the subject-matter of the present invention, irrespective of their summary in the patent claims or their back reference, as well as irrespective of their wording and representation in the description and the drawing, respectively.

BRIEF DESCRIPTION OF THE DRAWINGS

The sole FIGURE of the drawing shows schematically a hair treatment appliance of the invention illustrating a first embodiment thereof.

DETAILED DESCRIPTION

The FIGURE shows an appliance 1 with two elongate tong elements 2, 3 each of which has at least in the area intended for hair treatment approximately the shape of one half of a cylinder or part thereof sectioned longitudinally and/or crosswise. Hence each of the tong elements 2, 3 has an approximately plane sectioned surface 4, 5 and a cylindrical envelope surface 6, 7 arched in cross section. This enables the hair to be drawn over the arched cylindrical envelope surface 6, 7 with ease. The diameter of the cylinder varies preferably along its length, the diameter of the tong elements 2, 3 being at its maximum approximately midway along their length. The two tong elements 2, 3 are in such relative arrangement that the sectioned surfaces 4, 5 of the longitudinally sectioned cylinder face each other while the cylindrical envelope surfaces 6, 7 face the outside.

The two tong elements 2, 3 are at one of their ends hingedly connected with each other by means of a bearing 8. The two tong elements 2, 3 are thus movable relative to each other. In an open position the two tong elements 2, 3 include between them an angle. In this open position a user's hair may be placed between the tong elements 2, 3. In a closed position, the two sectioned surfaces 4, 5 of the tong elements 2, 3 are approximately in relative abutting engagement. In this closed position the hair treatment substance stored in the pad 11 may be activated, and the user's hair sandwiched between the tong elements 2, 3 may be pulled through between these tong elements 2, 3.

Tong element 2 accommodates a chamber 9 for holding water. Preferably the chamber 9 is arranged adjacent to the bearing 8 so that the force of a short lever has to be overcome by the user to open and close the tongs. The tong element 2 further carries a heating element 10 for heating and vaporization of the water. The generated steam is blown off or discharged through the sectioned surface 4 of the tong element 2 in the direction of the sectioned surface 5 of the tong element 3. The heating element 10 heats the cylindrical envelope surface 6 of the tong element 2 to a temperature in a range from about 100 degrees to about 120 degrees.

In the other tong element 3 the sectioned surface 5 is formed essentially by a fabric-type pad 11. The pad is comprised of two layers of felt joined together by ultrasonic welding. Further felt layers may be provided between the two felt layers. The layer structure is in particular configured such as to achieve a uniform dispensing action of the hair treatment agent during its application. The structure of the individual layers (which may also comprise materials other than felt) is configured for such partial solvent action by means of steam. The fabric-type pad 11 serves to receive a hair treatment agent.

One or both sectioned surfaces 4, 5 of the tong elements 2, 3 is or are provided with bristles 13 projecting in the direction of the respective opposite sectioned surface 4, 5. The cylindrical envelope surfaces 6, 7 of the two tong elements 2, 3 are provided with ribs 14 made in particular of a plastics material and aligned approximately transverse to the longitudinal direction of the tong elements 2, 3, causing hair drawn over the ribs to receive a parallel orientation in addition to affording protection against touching. The cylindrical envelope surface 6, 7 is made of a thermally conductive material, for example, aluminum, the cylindrical envelope surface 7 being heated in particular by the steam acting on the tong element 3 to a temperature in a range from about 80 degrees to about 100 degrees. Preferably the tong element 3 is particularly thin in cross-section, in particular smaller than 1 cm or smaller than 6 mm (without the pad), resulting in an effective conduction of heat to the cylindrical envelope surface 7. The cylindrical envelope surface 6 is heated by the heating element 10 direct.

The appliance 1 has a locking mechanism 15 to enable the two tong elements 2, 3 to be locked in their closed position.

Furthermore, the appliance 1 has a switch 16 for turning on and off in particular the heating element 10.

When the user turns the appliance 1 on, the water in the chamber 9 will be heated by the heating element 10. After a few seconds the water will vaporize, exiting on the sectioned surface 4 of the tong element 2. At this moment at the latest, unless from the very beginning, the tong elements 2, 3 are held together for a few seconds, preferably for about 20 to 30 seconds, in order to use the crimper in its function as an applicator of hair treatment agents, thereby causing steam to be generated and at least some of the dried hair treatment agent held in the opposite tong element to be liquefied by the steam. For example, provision is made for the tong elements to be unlocked not until after a predetermined interval of time has elapsed, or not until after a visual signal, as by means of an LED, or an audible signal occurs indicating that a time sufficient to effect partial solution of the hair treatment agent has elapsed, whereupon the user may disengage the two tong elements 2, 3. For hair treatment, particularly for hair repair or protection, the user then places a strand of hair in particular from the root or hair end region between the two tong elements 2, 3 of the appliance 1, subsequently returning the tong elements 2, 3 to the closed position. Combined with steam, the hair treatment agent then reaches the user's hair sandwiched between the tong elements 2, 3, while steam continues being applied by the tong element 2 and hair treatment agent is abraded mechanically from the pad 11 on the tong element 3 and applied to the hair as it is being drawn through. It will be understood, of course, that the hair treatment agent may also be applied to the hair so as to enable the user to treat the hair with the hair treatment agent by impregnating the hair ends, for example, with hair treatment agent from the pad 11 without using the drawing motion. In the other case, the user draws the hair through the two tong elements 2, 3 along the entire length of hair. The steam containing the hair treatment agent thus impacts the complete length of the user's hair. Subsequently or simultaneously, the user may pull the hair moistened by the steam over one or both cylindrical envelope surfaces 6, 7 of the appliance 1 or also wrap the hair around them. This dries the hair in addition to styling it to an inner or outer roll, if so desired. After the hair is pulled out of the appliance 1 completely, the user opens the two tong elements 2, 3, terminating the process.

With this device it is thus possible to treat only selected regions of the hair, for example, the root area, cover hair, the full hair length or only hair ends. This allows the specific treatment of, for example, only damaged regions of the hair, such as cover hair or hair ends, so that the hair protecting substance is applied only to those regions that are in need of treatment. The hair may be treated with an overall economical dose of hair care agent. The combination of steam with hair care agent enables the application to dry hair without the need to wash the hair in a preceding operation as is otherwise conventional procedure.

The above process may be repeated as often as desired. The user may remove the pad 11, substituting a fresh or a different hair treatment agent. Preferably the pad 11 holds hair treatment agent in amounts sufficient for at least one application. Simple application, removal and replacement of the pad are possible without requiring the user to contact the hair treatment agents (in dissolved condition) which sometimes are not well suited for the skin of a user's hands. Dosage of the hair treatment agent is controlled by the length of time allowed for the agent to react, the speed at which the hair is drawn through, the saturation of the hair and/or the amount of steam generated.

The hair treatment agent may contain a protein derivative, for example, a protein hydrolysate and/or a polyvinyl pyrrolidone and/or panthenol and/or glucose and/or any mixture, in particular a mixture of the three first mentioned substances. The hair treatment agent is held in the pad 11 in dried-in condition. To accomplish this, a solution of the hair treatment agent in ethanol and water (pH=3.5–5) is applied to the pad 11. Then the pad 11 is allowed to dry at a temperature of 60 degrees, approximately. The hair treatment agent is then stored in the pad 11 in a dried form. Accordingly, the appliance 1 is constructed such that a hair treatment agent present/stored in dry form is activated or dissolved by the generated steam and deposited on the hair in combination with the steam. Experience has shown that this enables a highly effective application of hair treatment agents, in particular hair protection agents, to be accomplished.

Although the embodiment of a crimper as presented in the foregoing affords handling advantages, unlike the embodiment described the appliance 1 may also be constructed in a manner similar to a curling iron in which a spring-loaded clamp can be urged away by a heated barrel. Similarly it is possible to dispense with the bristles 13 on the sectioned surfaces 4, 5 wholly or in part. The same applies to the ribs 14. Instead of the proposed arrangement for generating steam it is also possible to use an arrangement producing ionized steam. The pad 11 may contain membrane type materials enabling a delayed release of the hair treatment agent contained therein. The delay may be dependent in particular on the amount of steam or the temperature to which the pad 11 is heated by the steam. In addition it is also possible for the sectioned surface 4 of the tong element 2 to be provided with a pad, in particular with a felt layer, through which the generated steam passes, in which case steam vents may be provided on the cylindrical envelope surfaces 6, 7. By suitably constructing the tong element 3 it is possible to operate the appliance 1 also without the pad 11 and thus as a steam crimper.

It will be appreciated that as an alternative or addition to the hair treatment agent referred to, other hair care agents and/or hair repair agents and/or hair styling agents or the like may be provided.

What is claimed is:

1. A hair treatment appliance comprising:

two elongate tongs movable relative to each other between an open and a closed position, between which hair is insertable with the tongs in the open position and between which the hair may be pulled through with the tongs in the closed position;

a steam generator arranged to introduce steam between the two tongs; and a hair treatment release device positioned to expose a hair treatment agent contained thereby to said steam, the device only releasing the hair treatment agent upon exposure to said steam, and directing released hair treatment agent between the two tongs.

2. The appliance of claim 1, wherein the hair treatment release device is received in one of the two tongs.

3. The appliance of claim 2, wherein the hair treatment release device includes a fabric-type pad for containing the hair treatment agent.

4. The appliance of claim 3, wherein the fabric-type pad comprises a felt material.

5. The appliance of claim 1, wherein the hair treatment release device comprises a replaceable unit for containing and releasing the hair treatment agent.

6. The appliance of claim 1, wherein the steam generator includes a heating element and a chamber for receiving a liquid.

7. The appliance of claim 2, characterized in that the steam generator is disposed in another of the two tong elements.

8. The appliance of claim 1, wherein at least one of the two tong elements has bristles projecting toward another of the two tong elements.

9. The appliance of claim 1, wherein at least one of the two tong elements has a heatable cylindrical envelope surface.

10. The appliance of claim 1, wherein at least one of the two tong elements has a cylindrical envelope surface with ribs.

11. A hair treatment appliance comprising:

two elongate tongs movable relative to each other between an open and a closed position, for receiving hair therebetween in the open position and between which the hair may be pulled through in the closed position;

a steam generator arranged to introduce steam between the two tongs;

a hair treatment agent contained by the hair treatment release device;

wherein the hair treatment release device is a hair treatment release device; and arranged to expose said hair treatment agent contained thereby to said steam to release hair treatment agent exposed to said steam between the two tongs;

wherein the hair treatment agent is activatable by the steam inactive and contained by the hair treatment agent remaining the release device until exposed to the steam.

12. The appliance and hair treatment agent combination of claim 11, wherein the hair treatment agent contains a protein derivative.

* * * * *